United States Patent [19]

Schminke et al.

[11] 4,248,610

[45] Feb. 3, 1981

[54] DUST COLLECTOR WITH PRESSURE-RELIEF OPENING

[75] Inventors: Heinz Schminke, Egelsbach; Rudolf Krebs, Kronberg; Günter Wendel, Frankfurt am Main; Hans-Jürgen Schmidt, Sulzbach; Willy Desch, Heusenstamm; Jürgen Nitz, Neu-Isenburg, all of Fed. Rep. of Germany

[73] Assignee: Metallgesellschaft Aktiengesellschaft, Frankfurt am Main, Fed. Rep. of Germany

[21] Appl. No.: 63,166

[22] Filed: Aug. 2, 1979

[30] Foreign Application Priority Data

Aug. 9, 1978 [DE] Fed. Rep. of Germany ..... 2834847

[51] Int. Cl.[3] ..... B03C 3/82

[52] U.S. Cl. ..... 55/101; 55/310; 55/385 F; 52/98; 165/81

[58] Field of Search ..... 55/101, 309, 310, 311, 55/359, 385 F; 52/1, 98; 165/81

[56] References Cited

U.S. PATENT DOCUMENTS

| | | | |
|---|---|---|---|
| 2,679,467 | 5/1954 | Sherts | 52/98 |
| 2,921,592 | 1/1960 | Mackey | 52/1 |
| 3,258,887 | 7/1966 | Mostoller | 52/98 |
| 3,363,376 | 1/1968 | Wendel et al. | 55/101 |
| 3,386,215 | 6/1968 | Wendel et al. | 55/101 |
| 3,765,135 | 10/1975 | Gerhardt | 52/98 |
| 3,828,493 | 8/1974 | Vezmar | 52/1 |
| 3,864,881 | 2/1975 | Wolf | 52/1 |
| 3,899,311 | 8/1975 | Rapp | 55/311 |
| 4,027,436 | 6/1977 | Daly | 52/1 |

*Primary Examiner*—David L. Lacey
*Attorney, Agent, or Firm*—Karl F. Ross

[57] ABSTRACT

A dust-collecting electrostatic precipitator has a housing, the top of which is adapted to form a pressure-relief opening and is closed by a sealing membrane divided by a plurality of intentional tear lines into zones which can be blown upwardly and back to relieve pressure within the housing. The membrane is covered, in turn, by a rain-shielding roof spaced above the sealing top and having a portion forming an elastic cover which is only loosely held against internal pressure.

15 Claims, 13 Drawing Figures

(X)

(Y)

(X)

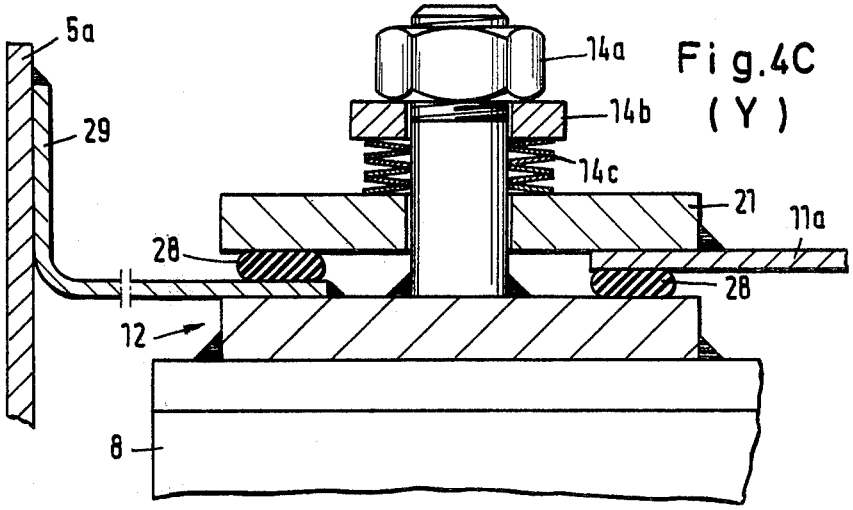
Fig.4C
(Y)
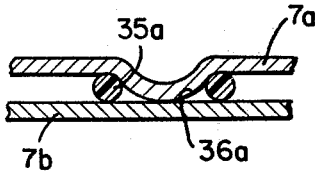
Fig.8
Fig.5
(Z)
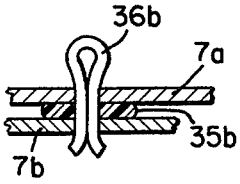
Fig. 7
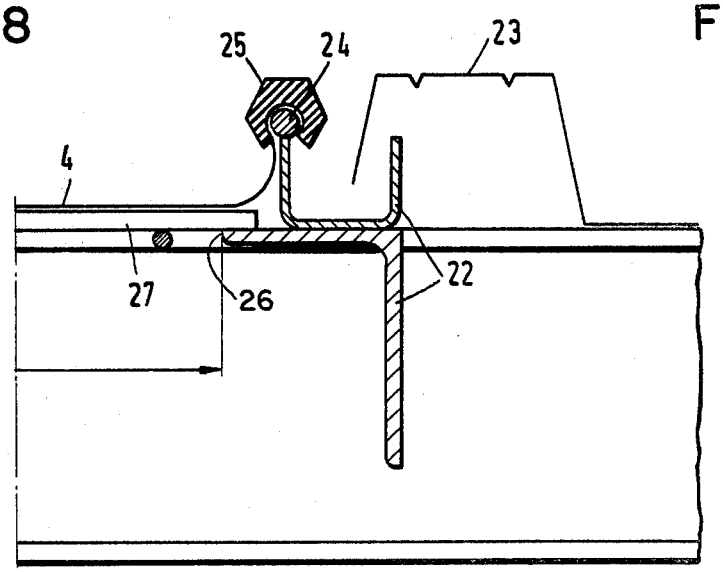

DUST COLLECTOR WITH PRESSURE-RELIEF OPENING

FIELD OF THE INVENTION

The present invention relates to dust-collecting electrostatic precipitators and, more particularly, to dust collecting units having pressure-relief openings for relieving internal pressure within a housing and in which the housing may be subjected to explosion or other spontaneous pressure increase in use.

BACKGROUND OF THE INVENTION

Electrostatic precipitators and other dust collectors, operating with housings which receive explosive or otherwise expandable mixtures, are customarily provided with pressure-relief openings through which a sudden increase of pressure can be vented to prevent a shock wave or like contained expansion or explosion of gases from destroying the dust collector or internal fixtures thereof.

Electrostatic precipitators have been used heretofore where the composition of the gas or the nature of the dust to be collected resulted in an expectation of detonation or explosion even under normal operating conditions. Typical of this first class of dust collectors or electrostatic precipitators are those which follow steel-making converters to effect at least partial cleaning of the gases drawn therefrom before these gases are released into the atmosphere. Explosive components of such gases include carbon monoxide and particulates which undergo violent or spontaneous chemical reactions producing more moles of reaction product than moles of reactant.

A second class of electrostatic precipitators are those which are not operated under the expectation of detonation or explosion in normal usage, but wherein detonation or explosion cannot be precluded when troubles arise in the operation of the installation. Such systems include gas purifiers following heat-exchange furnaces or rotary kilns in the cement industry.

A third class of dust collector or heat exchanger is that in which detonation or explosion cannot occur at all. Typical of these dust collectors or electrostatic precipitators are those which follow grinders, millers and steam boilers.

With dust-collecting installations of the latter type, the housing can be designed simply to withstand the pressure generated in normal use and ranging from slightly above atmospheric pressure (0 bar) to −2000 millibar (mb).

In the two fields of application originally mentioned, however, the housing must be designed to withstand not only the normal operating pressure but explosion pressures, detonation waves and the like which may be as high as 12 bars.

For economic reasons, it is neither practical nor possible to design structures so massive as to be capable of withstanding these pressures.

As a result, it is a practical necessity to provide pressure-relief openings with closure members, e.g. explosion-responsive hinged doors, to limit the pressure rise in the case of an explosion or detonation.

When such pressure-relief openings are provided, naturally, the pressure buildup within the dust collector is vented as the doors are opened. The size of the pressure-relief openings and the threshold pressure at which the doors respond are so selected that the housing can have sufficient strength for normal operations with the vents closed, but nevertheless the cost of the unit can be minimized. A typical threshold in the first case, i.e. when detonation or explosion may be expected with normal operation is generally around 1.5 to 2 bar.

In other words, at pressures of this level, the housing cannot stand any significant permanent deformation upon the development of an explosive force.

Naturally, certain relationships between relief-apertures cross section and threshold pressure must be observable Because the detonations and explosions occur relatively frequently, the pressure relief means which are employed must automatically reestablish a gas-tight seal after an explosion. Under these conditions, the dust collector or precipitator may continue in operation after many detonations or explosions without the need for repair. Consequently, while the initial cost for a pressure vessel and resealing pressure-relief openings may be relatively high, the number of explosive incidents precludes underdesigning in any system which would require frequent maintenance or replacement of parts, in the second field of application mentioned above, i.e. those in which detonations or explosions cannot occur under normal operating conditions but nevertheless may occur infrequently in the event of operating problems, a different approach may be taken.

In the latter case it may be more economical to design the housing so that it can respond to pressure surges, i.e. to be resistant to a pressure surge. This means that infrequent permanent deformation of housing walls can result from explosions while subsequent repair or replacement is tolerable. An advantage of this system, of course, is that the housing is usually designed so as not to burst with the usual explosive forces which may be expected upon a failure of the operating system. The design can be based upon the yield point of ferritic steels or the 1% offset point of austenitic steels as measures of the permissible stress to which wall members of these steels may be subjected. No margin of safety need be given since replacement of damage from an explosive incident is taken into consideration.

In systems of the latter case it has also been found to be advantageous to minimize the replacement cost and frequency of repair, to provide pressure-relief openings. It is not unusual, with these systems, to provide a pressure-relief opening which vents or responds at a threshold pressure of 0.25 bar and, because of the low threshold relief pressure, to provide a correspondingly larger flow cross section for the pressure relief means.

For systems in which detonations or explosions are not expected during normal operation but cannot be precluded in the event of operational problems, e.g. in exhaust gas purifying installations or dust collectors downstream of heat exchange furnaces or rotary kilns in the cement industry, it has been proposed (see German Pat. No. 1,297,082) to provide a dust collecting electrostatic precipitator whose housing top is constituted as an explosion-responsive flap.

The top of the dust collector is resiliently clamped and held in a gas-type manner against roof girders and side walls of the dust collector and is subdivided into a number of strips which are sealed, in turn, to obtuse-angle strips. In the event of explosion, these angle strips are bent more sharply upwardly so that the several segments approach one another and the top of the dust collector is effectively reduced in length and is pulled out of the means whereby its edges are gripped, thereby enabling the entire top to be raised in the relief of pressure within the housing.

While this system is effective for limited relief, it does not fulfill all of the requirements since an explosion in the dust collector results in a rapid pressure rise and high-speed shock waves whose destructive effect can only be limited if the pressure-relief means responds rapidly and forms a pressure relief opening of sufficient area.

With the system just described, the mass and inertia of the parts which had been deformed to expose the pressure relief cross section were such that significant delay was created and hence the system was unsatisfactory because damage to the housing walls could not be avoided. An additional defect in earlier systems of this type was that the clamping systems used for securing the top of the housing to the walls did not permit a well-defined release of the pressure and hence the overall system did not have a predetermined response threshold pressure. In other words, while it is a requirement that the housing be sealed, the sealing means used did not permit the pressure-relief system, as a whole, to have a predetermined threshold value at which the internal pressure was reliably relieved at a rate sufficient to preclude damage to the balance of the collector. In fact, the clamping characteristics changed as a function of weather and rendered the system unreliable.

Finally, in this connection, it was found that the pressure wave tore away all covering for the collector so that the latter was not even left with a rain-shielding roof or the like.

OBJECTS OF THE INVENTION

It is the principal object of the present invention to provide an improved dust-collecting electrostatic precipitator which is free from the disadvantages of earlier systems, especially with respect to pressure relief upon the development of a detonation or explosion within the unit.

Another object of the invention is to provide an electrostatic precipitator with improved pressure-relief means particularly for use in systems in which detonations and explosions do not occur during normal operating conditions but cannot be precluded in the case of an abnormality in operation, e.g. some trouble.

It is also an object of this invention to provide a pressure-relief system for an electrostatic precipitator which can hold the pressure rise in the unit below the design pressure for the dust collector housing and which minimizes damage which may result from explosion so that any damage which does occur is confined to the pressure-relief structure.

Still another object of the invention is to provide an electrostatic precipitator capable of withstanding an explosion without having portions of the housing torn away and posing a danger to the environment.

Because, in vessels having pressure-relief openings the maximum pressure which can develop is directly related to the pressure required to open the vessel and to the pressure-relief cross section area.

Another object of the invention is to provide a system whereby the pressure required to open the vessel (threshold pressure) is constant and as low as possible while being clearly defined.

SUMMARY OF THE INVENTION

These objects and others which will become apparent hereinafter, are attained in accordance with the present invention, by providing an electrostatic precipitator having a housing and means within the housing for the electrostatic precipitation of dust, such means being conventional in the art and including, for example, dust-collecting electrodes, corona discharge electrodes rappers, dust-collecting bins and the like.

The housing, according to the invention, is provided with a top adapted to form a pressure relief opening but, in turn, has a sealing top or member formed with a plurality of intentional break lines (weakened lines or score lines) subdividing it into fields. An essential feature of the invention is a rain-shielding roof disposed over the sealing top and comprising an elastic portion which is only loosely held against internal pressure, i.e. can be forced outwardly by a pressure wave released upon separation of the portions of the sealing top at the tear lines.

According to a feature of the invention, the tear lines of the sealing top are arranged so that the escaping pressure wave is positively guided to the elastic portion of the rain shielding roof when the sections separated along the tear lines are rolled back by the escaping pressure wave. The tear lines may extend parallel to the direction of flow of the gas in the dust collector or at right angles to the direction of flow of gas, or at an acute angle thereto, it being understood that tear lines combining two or more of these directions may be provided as well.

The sealing top is secured at points spaced from the tear lines, e.g. along the roof girders and side walls, so that at these points the sections defined by the tear lines are fixed and cannot be separated from the structure by the shock wave, whereby the sections bend upwardly and outwardly from these points.

In one embodiment of the invention, the fields defined by the tear lines are constituted by sheet metal panels which are secured to the roof girders and the side walls of the housing and are provided with connecting means extending along the tear lines to constitute intentional or rated breaking points.

The "rated" breaking point or line is, of course, a zone of predetermined weakness in the member which allows separation at the point or line when a predetermined pressure is applied across the member without tearing of the member between these points or lines. In other words, rupture is intended at such points or lines upon development of a predetermined pressure within the vessel.

The rated breaking points or intentional break points may be formed by notched straps, by screws, by rivets or split pins with or without notches, or by spot welded score lines or thin zones unitarily formed in the material provided with the intentional break points.

In another embodiment of the invention, the sealing top consists of a plurality of sheet metal panels which have stiffened edges and are secured by appropriate fastening means to the roof girder and side walls and, along the tear lines, through the intermediary of a gasket with a carrying structure. The fastening means between the panels, sealed by the gasket, have rated breaking pressure and may be constituted in the manner previously described.

Other rated breaking elements can be used as well to join and seal the panel together. For example, the fastening means can comprise a studded plate, an inner cylinder, an outer cylinder and mating screw thread means, a spring and one or more notched pins which connect the cylinders. The notched pins can be used to establish a threshold response pressure or opening pressure which is as small as possible. The spring between the screw thread means and the cylinders, ensures a constant threshold pressure even when the elasticity of the gasket decreases with time.

In an alternative construction, inner and outer rings are adhesively connected together. The stiffened edge portions of the sheet metal panel may consist of L section edge portions formed along the tear lines and perforated flat-bar edge portions along the roof girder and lateral walls of the precipitator housing.

The rain-shielding roof preferably is constituted by corrugated panels whose corrugations are trapezoidal in cross-section, these panels resting upon a carrying structure. When these panels lie above tear lines of a sealing top and extend transversely to the direction of flow of gases in the dust collector the roof may have a portion consisting of a strip-shaped covering cloth (fabric) which extends substantially over the entire width of the top and which is preferably drawn at its longitudinal edges around rounded profiled edges of the carrying structure, being there secured by elastic clamping bars. To relieve the clamping means securing the covering fabric in place, the latter may rest upon a support grid.

In the dust collector according to the invention the top forming the pressure-relief opening has the advantage that there are clearly defined, rated or intentional break points or tear lines which, in the event of an explosion, respond at the predetermined constant pressure to expose without appreciable delay a large-cross section pressure relief opening. The tear lines ensure that the pressure relief opening will be formed in the center portion of each field of the top in an arrangement in which the rain shielding roof consists only of a yieldable or elastic cover only loosely held against internal pressure.

BRIEF DESCRIPTION OF THE DRAWING

The above and other objects, features and advantages of the present invention will become more readily apparent from the following description, reference being made to the accompanying drawing in which:

FIG. 4C is a detail view of region Y of FIG. 3A;

FIG. 5 represents the detail Z indicated in FIGS. 1A and 3A; and

FIGS. 6, 7 and 8 show additional alternative arrangements of tear lines.

SPECIFIC DESCRIPTION

Figure 1A:
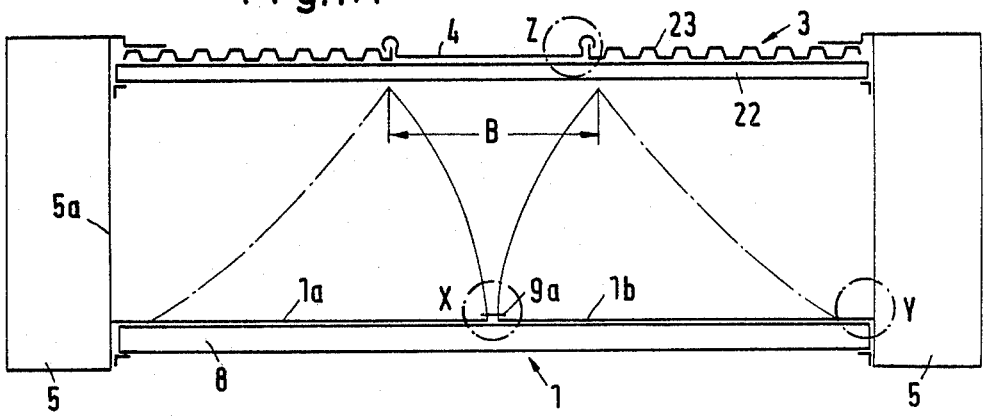
FIG. 1A is a vertical sectional view showing a top for an electrostatic precipitator according to the invention.

FIG. 1A is a highly simplified sectional view showing a portion of a top of a dust collector. The section line is taken parallel to the direction of flow in the dust collector.

Depending on the number of dust-collector fields, additional similar top portions may adjoin roof girders 5 on the right and left.

In this embodiment a sealing top 1 lies loosely on a carrying structure 8 and is gas-tightly connected at Y to web plate 5*a* of the roof girder 5.

Individual fields 1*a* and 1*b* of the sealing top 1 terminate at X and are gas-tightly joined thereto by a strap 9*a* placed on top. That strap has a rated breaking point 10, which consists of a defined notch (see FIG. 2A).

A rain-shielding roof 3 is spaced over the sealing top and consists substantially of trapezoidal sheet metal elements 23 and lies on a carrying structure 22. A portion of the rain-shielding roof consists of an elastic cover or fabric 4, which is only loosely held at its edges against internal pressure. In case of an appreciable pressure rise caused inside the dust collector by a detonation or explosion, the strap 9*a* will be torn apart at its rated breaking point 10 and the fields 1*a*, 1*b* of the sealing top 1 will be bent upwardly, as shown. This results in a formation of a pressure relief opening having the width B in the sealing top and immediately thereafter in the rain-shielding roof 3 because the elastic cover 4 is detached from its fixing means. Without need for a movement of substantial masses, a fast pressure relief is thus ensured so that the remainder of the housing of the dust collector remains substantially intact.

Figure 1B:
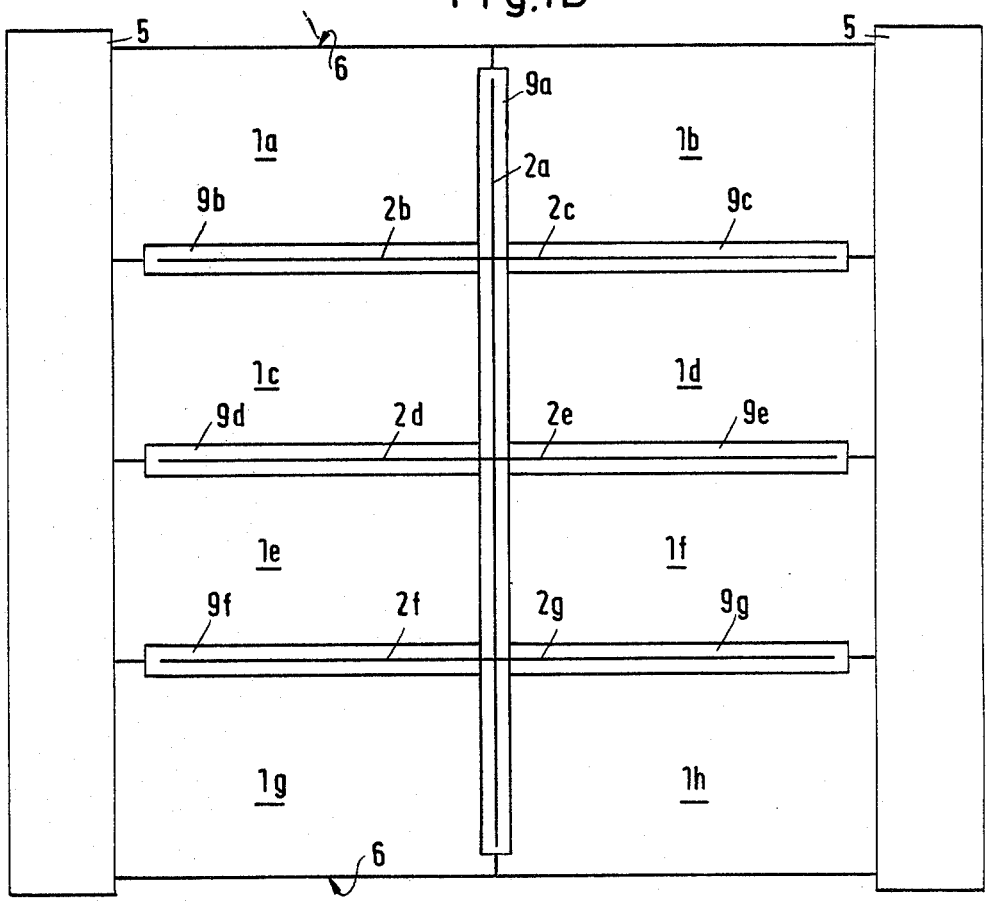
FIG. 1B is a top plan view of the sealing top of FIG. 1A.

From FIG. 1B, which is a top plan view of the sealing top, it is apparent that the entire top is divided into fields 1*a* to 1*h* and that straps 9*a* to 9*g* are provided at the boundaries of the fields and in case of an explosion will be destroyed along the tear lines 2*a* to 2*g*.

As a result, the fields bend upwardly to define a pressure relief opening having an area which depends on the explosion pressure. The fields 1*a* to 1*h* are joined to the roof girders 5 and the side walls 6 so that they cannot be torn off there.

Figure 2A:
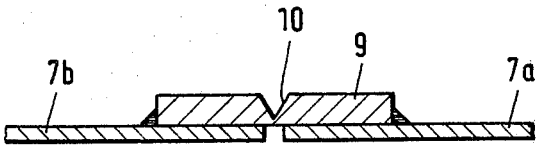
FIG. 2A is a detail view of the region X indicated in FIG. 1A.

FIG. 2A is an enlarged view showing the detail X. Fields consisting of sheet metal panels 7*a* and 7*b* are gas-tightly interconnected along the tear lines by a strap 9 placed on top. The strap has a rated breaking point 10, which consists of a defined notch. The remaining thickness of the strap at the bottom of the notch determines the desired response threshold pressure.

Figure 2B:
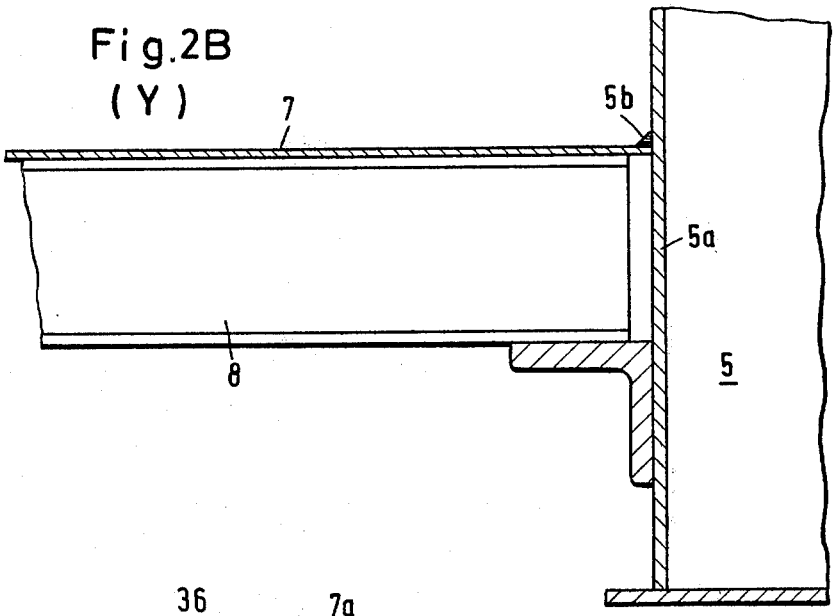
FIG. 2B is a detail view of the region Y indicated in FIG. 1A.
Figure 2B:
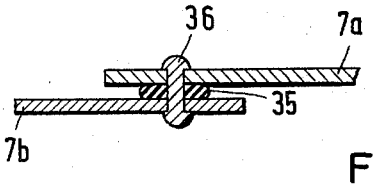

FIG. 2B shows that sheet metal panels 7 lie on the carrying structure 8. The latter is connected to the web 5*a* of the roof girder 5. The top panel is gas-tightly welded at 5*b* to the roof girder 5.

Figure 3A:
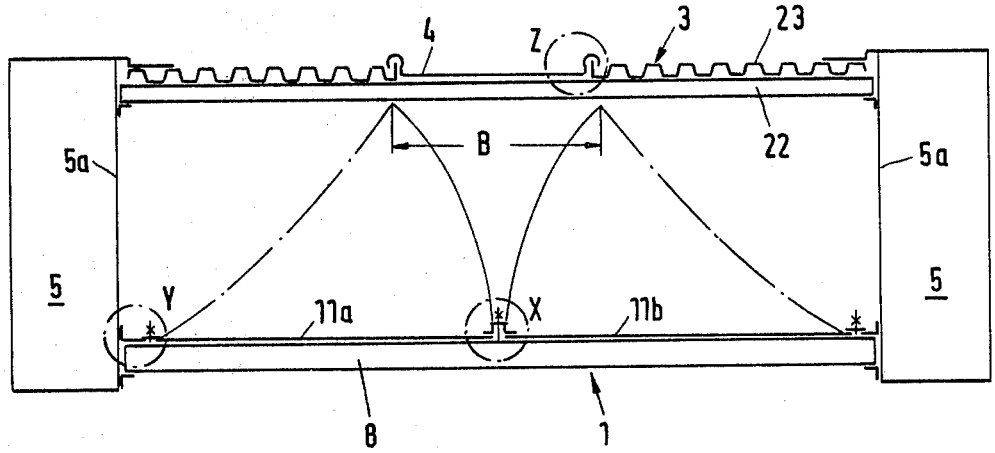
FIG. 3A is a vertical sectional view showing an alternative sealing top.

FIG. 3A shows another embodiment of the sealing top. Sheet metal panels 11*a* and 11*b* having stiffened edges are secured to the carrying structure 8 by fastening means which will be described more fully hereinafter. The rain-shielding roof 3 comprising the carrying structure 22, the sheet metal elements 23 with trapezoidal-section corrugations and the elastic cover 4 is similar to that of FIG. 1A.

In case of an explosion the sheet metal panels 11*a* and 11*b* will be bent upwardly, as shown, to form a pressure relief opening having the width B.

Figure 3B:
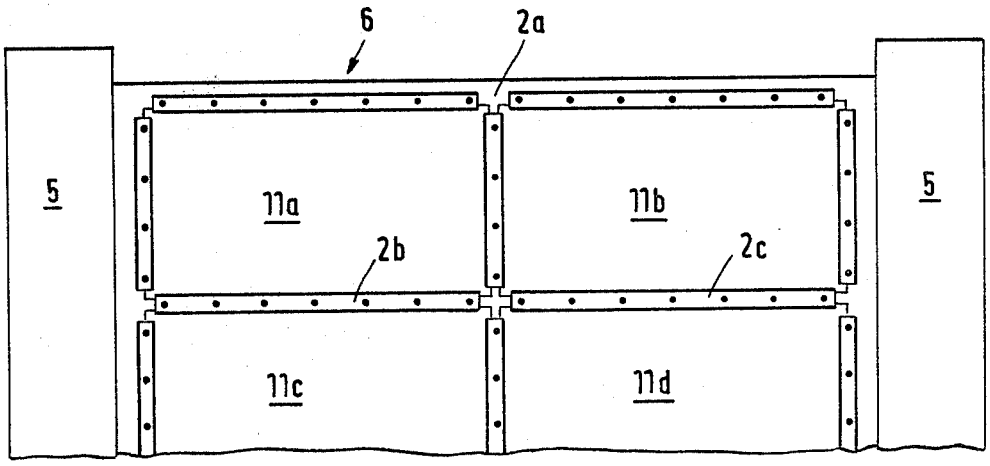
FIG. 3B is a top plan view showing part of the sealing top of FIG. 3A.

From the fragmentary top plan view shown in FIG. 3B, the sheet metal panels 11*a* to 11*d* can be seen to form fields. The fastening means which are provided along the side wall 6 and the roof girders 5 will be explained hereinafter and serve to retain the sheet metal panels in position there. Along the tear lines 2*a* to 2*c*. the fastening means have rated breaking points, which in case of an explosion break so that a pressure relief opening is formed.

Figure 4A:
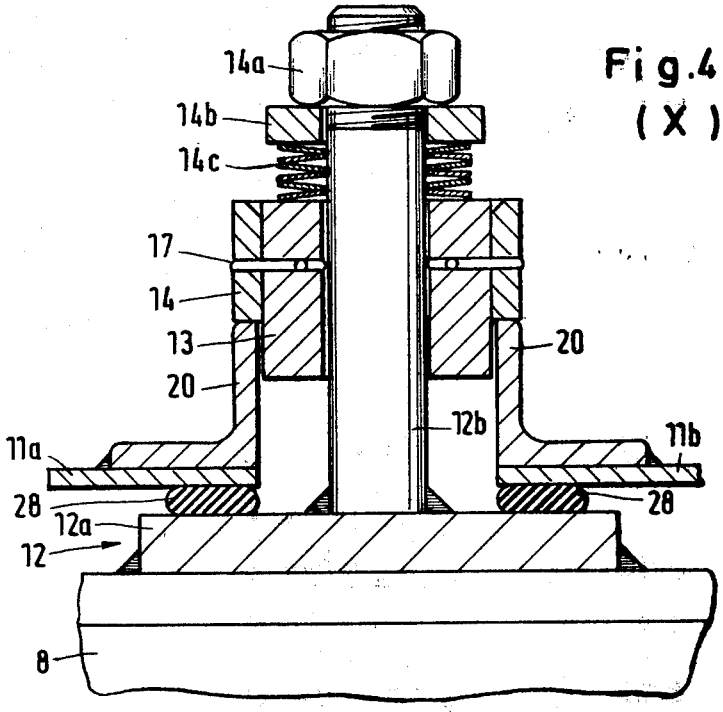
FIG. 4A is a detail view of the region X indicated in FIG. 3A.
Figure 4B:
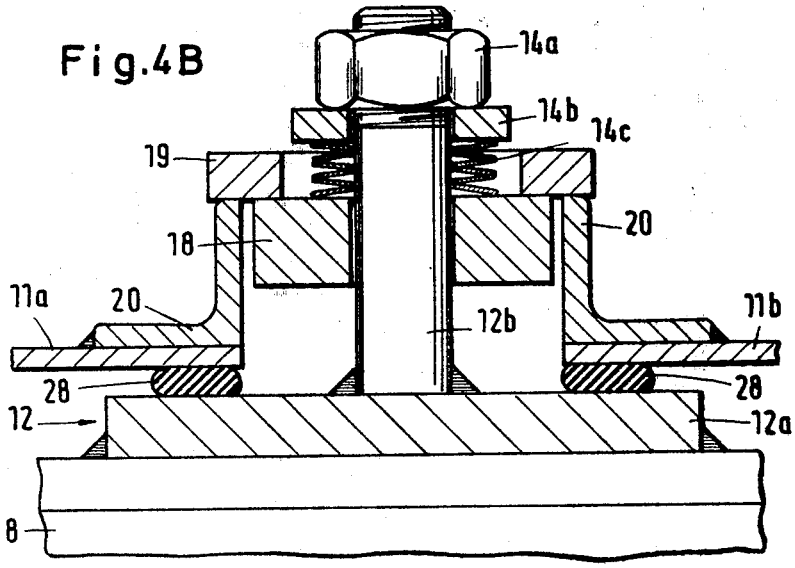
FIG. 4B is an alternative embodiment of the detail X indicated in FIG. 3A.

FIG. 4A is an enlarged view showing the detail X indicated in FIG. 3A. A studded plate 12 comprising a metal strip 12*a* and screw-threaded studs 12*b* welded thereto is secured to the carrying structure 8. The variant of FIG. 4B uses a nut 14*a* to hold a washer 14*b* against a spring 14*c* surrounded by a ring 19 secured to a seat 18 surrounding the bolt 12*b* between the panels 11*a* and 11*b*.

The sheet metal panels 11*a* and 11*b* have stiffened L-section edge portions 20 and lie on a gasket 28 and are secured to the carrying structure by fastening means 14*a* to 14*c*. More specifically, the nut 14*a* and the washer 14*b* form a seat for the spring 14*c* around a bolt rising from the plate 12 to elastically press a plate 21 and the panel 11*a* against the gasket 28 (FIG. 4C).

Attention is directed to the fact that the fastening means have no rated breaking points so that the sheet metal panel 11*a* cannot come loose at said fixed portion in case of an explosion.

The edge is connected to the web 5*a* of the roof girder by means of a flanged plate 29, which is welded to the web 5*a* and to the studded plate 12. A gasket 28 is provided between the perforated plate 21 and the flanged plate 29.

The detail Z indicated in FIGS. 1A and 3A is shown in FIG. 5, which is a fragmentary sectional view of the rain-shielding roof comprising a carrying structure 22, trapezoidal plates 23 placed thereon, and an elastic cover 4. The latter may consist of a cloth or the like, which at its longitudinal edges has been drawn around rounded-section edges 24 and has been secured there to the carrying structure 22 by resilient clamping bars 25. Adjacent to the opening 26, the covering cloth 4 may lie on a carrying grid 27 so that the cloth 4 cannot sag and the clamping means are relieved from snow loads.

Figure 6:
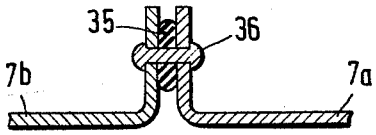

FIG. 6 is a simplified vertical sectional view showing additional arrangement of tear lines. In the upper portion of the Figure, sheet metal panels 7*a* and 7*b* are shown, which have overlapping edge portions. A continuous gasket 35 extends in the overlap area. The sheet metal panels are held together by regularly spaced apart rivets 36. The lower portion of the Figure differs from the upper one in that the sheet metal panels 7*a* and 7*b* have upturned edge portions, which are provided with an interposed gasket 35 and are forced against each other at spaced apart points. This may be effected by rivets 36.

The rivets shown in FIG. 6 constitute rated breaking points, which in case of an explosion will be torn apart so that the sheet metal elements 7*a* and 7*b* can bend up. The rivets may be replaced by different connecting means, such as screws, split pins 36*b* connecting the members through the gasket 35*b*, or spot welds 36*a* associated with gaskets 35*a* shown in FIGS. 7 and 8 respectively. If a tearing of a sheet metal panel rather than the fastening means is to be reliably avoided, it is advantageous to reinforce the sheet metal panels adjacent to the gaskets 35. Such reinforcement may consist of a welded-on rail, which is not shown in the drawing.

We claim:

1. In a dust-collecting electrostatic precipitator having a housing traversed by a gas in a given direction and a top assembly adapted to forming a pressure relief opening for venting pressure from said housing, the improvement wherein said assembly comprises:

a sealing top sealed to said housing and divided by a plurality of intentional tear lines into fields adapted to be bent upwardly upon the development of an excess pressure in said housing and thereby form at least one pressure relief opening; and a rain-shielding roof spaced above said top and provided with a portion having a loosely held elastic cover at least in the region of said at least one opening and deflectible outwardly by a pressure wave emanating from said at least one opening.

2. The dust-collecting electrostatic precipitator defined in claim 1, further comprising roof girders spanning side walls of said housing, and means for securing said top to said roof girders and said side walls.

3. The dust-collecting electrostatic precipitator defined in claim 2 wherein said fields consist of sheet metal panels secured at least at one side to said roof girders and said side walls respectively and provided along the tear lines with connecting means forming rated breaking points.

4. The dust-collecting electrostatic precipitator defined in claim 3 wherein said connecting means includes notched straps.

5. The dust-collecting electrostatic precipitator defined in claim 3 wherein said connecting means includes screws.

6. The dust-collecting electrostatic precipitator defined in claim 3 wherein said connecting means includes rivets.

7. The dust-collecting electrostatic precipitator defined in claim 3 wherein said connecting means includes split pins.

8. The dust-collecting electrostatic precipitator defined in claim 3 wherein said connecting means includes spot welds.

9. The dust-collecting electrostatic precipitator defined in claim 2 wherein said sealing top consists of a plurality of sheet metal panels having stiffened edges and secured by respective fastening means to said roof girders and side walls, a carrying structure being provided across said at least one opening and said sheet-metal panels being secured to said carrying structure with interposed gaskets by respective fastening means having rated breaking points.

10. The dust-collecting electrostatic precipitator defined in claim 9 wherein said fastening means includes a studded plate, an inner cylinder, an outer cylinder, male and female screw threaded means, a spring and at least one notched pin connecting the cylinders.

11. The dust-collecting electrostatic precipitator defined in claim 9 wherein said fastening means includes a studded plate, an inner ring, and an outer ring adhesively joined to said inner ring.

12. The dust-collecting electrostatic precipitator defined in claim 9 wherein the stiffened edges of said panels are formed with L-section edge portions along said tear lines and perforated flat-bar edge portions along the roof girders and side walls.

13. The dust-collecting electrostatic precipitator defined in claim 1 wherein said roof comprises a plurality of corrugated panels having a corrugation of trapezoidal cross section mounted on a carrying structure, a strip-shaped fabric forming part of said elastic cover and being affixed to said panels above said opening and extending transversely to said direction of flow across substantially the entire width of the top.

14. The dust-collecting electrostatic precipitator defined in claim 13 wherein the fabric is retained at longitudinal edges around rounded profiled edges of said carrying structure and is secured to the latter by elastic clamping bars.

15. The dust-collecting electrostatic precipitator defined in claim 13, further comprising a carrying grid, said fabric resting upon said carrying grid.

* * * * *